United States Patent [19]

Fecker et al.

[11] 4,056,239

[45] Nov. 1, 1977

[54] YARN SUPPLY APPARATUS FOR POSITIVE THREAD SUPPLY

[75] Inventors: Josef Fecker, Steinhofen-Bisingen; Gustav Memminger, Freudenstadt, both of Germany

[73] Assignee: Firma Gustav Memminger Verfahrenstechnik fur die Maschenindustrie, Freudenstadt, Germany

[21] Appl. No.: 642,605

[22] Filed: Dec. 19, 1975

[30] Foreign Application Priority Data

Oct. 4, 1975 Germany ..... 2544495

[51] Int. Cl.[2] ..... B65H 51/20

[52] U.S. Cl. ..... 242/47.01; 66/132 R; 242/47.12

[58] Field of Search ..... 242/47.01, 47.02, 47.03, 242/47.04, 47.05, 47.06, 47.07, 47.08, 47.09, 47.1, 47.11, 47.12, 47.13; 66/132 R; 139/122 R

[56] References Cited

U.S. PATENT DOCUMENTS

| | | | |
|---|---|---|---|
| 3,625,444 | 12/1971 | Hatay | 242/47.01 |
| 3,720,384 | 3/1973 | Rosen | 242/47.01 |
| 3,820,731 | 6/1974 | Rosen | 242/47.12 |
| 3,908,921 | 9/1975 | Jacobsson | 242/47.01 |

*Primary Examiner*—Stanley N. Gilreath
*Attorney, Agent, or Firm*—Flynn & Frishauf

[57] ABSTRACT

To permit ready reversal of rotation of a yarn supply drum, and to positively guide yarn being drawn off the drum, a thread guide element in form of a finger is located laterally offset with respect to the axis of rotation of the storage drum, extending essentially in a direction transverse to a tangential plane at the pull-off point of the yarn, the lateral offset being changeable to either side of the pull-off point to accomodate different directions of rotation of the drum, with simple change-over of the yarn guide finger, for example by re-positioning a mounting plate to extend either towards the left or the right from a support arm.

11 Claims, 4 Drawing Figures

YARN SUPPLY APPARATUS FOR POSITIVE THREAD SUPPLY

Cross reference to related applications:

U.S. Ser. No. 642,655,, filed Dec. 19, 1975, Fecker et al.;

U.S. Ser. No. 642,257, filed Dec. 19, 1975, Fecker et al.;

both assigned to the assignee of the present application.

The present invention relates to yarn or thread supply apparatus for positive thread supply to supply yarn or thread to a textile machine at a utilization point, for example to the knitting feed of a circular knitting machine.

Various types of utilization apparatus have previously been proposed. German Publication Document DT-AS No. 2,312,267, to which U.S. PAT. 3,908,921 corresponds, describes a thread supply apparatus of the type to which the present invention relates in which a hook-shaped thread guide element is arranged near the thread supply drum. The open loop of the hook is pointed in the direction of rotation of the drum, supported from a fixed arm. The hook extends laterally beneath the outline of the storage drum and forms a fixed pull-off position for the yarn or thread being drawn or pulled off from the storage drum over the axial end thereof. Thus, the same quantity of thread can be pulled off the drum as is being supplied thereto on a storage winding being wound on the drum. The hook itself is pivotally located in a hub secured to the support arm therefor.

Thread supply apparatus utilizing a hook which is rotatably held in a hub results in a comparatively complicated device. The open loop of the hook constrains the movement of the thread or yarn as it is drawn off and particularly prevents the yarn from having a reversing, two-and-fro movement. Additionally, the apparatus is suitable only for one direction of rotation of the drum. Various types of textile machines, and particularly circular knitting machines, are in use, however, which have different directions of operation.

It is an object of the present invention to provide a yarn or thread supply apparatus which is simple, can be equally used for textile machines operating in either direction and use storage drums which can be operated in either direction, and which do not require separate different structures to accomodate different directions of rotation.

SUBJECT MATTER OF THE PRESENT INVENTION

Briefly, the thread guide element is a pin or finger which extends transversely to the direction of rotation of the storage drum and which is laterally offset with respect to the axis of rotation of the storage drum. The direction of offset, that is, to the left or to the right of a radial line from the center of the storage drum, is selectively settable, the position of the pin or finger to the left or to the right then accomodating different directions of rotation of the drum.

The pin is preferably made of ceramic material and cylindrical. It is preferably located close to the bottom surface of the drum, which bottom surface is preferably essentially flat and extends parallel thereto. Since the pin, made of a hard material which is not damaged by the yarn being drawn off thereover, nor does damage to the yarn itself, is laterally offset with respect to the axis of rotation, the yarn can wind itself to a greater extent on the storage drum if the textile machine utilizing the yarn does not take up as much yarn as is being supplied thereto. If the extent of slack in the yarn, however, exceeds a critical level, a stop-motion device can readily be activated. The pin is easily made and can be manufactured of material which is of extreme hardness and thus difficult to be worked on or to be deformed once constructed, since a plane cylindrical pin is an easily manufactured element.

In a preferred form, the pin is secured to a support plate which, in turn, is secured to a frame. The support plate is guided in a guide track and can be located, selectively, in different positions in which the lateral offset of the pin is reversed, that is, the pin positions are rotated with respect to each other by 180°. Upon changing the direction of rotation of the drum from clockwise to counter-clockwise, however, or in the reverse, it is only necessary to loosen the support plate and reset it in the oppositely located direction.

A stop-motion device can be associated with the drum and with the thread guide; in accordance with a feature of the invention, the stop-motion device is located immediately beneath the thread guide pin and a holding latch is provided so that the stop-motion device can be locked in a fixed position. When in operation, the yarn is drawn off the drum, runs over the thread guide pin and then passes by the stop-motion device, which provides for a particularly effective and simple sensing of proper yarn feeding operation.

The invention will be described by way of example with reference to the accompanying drawings, wherein.

Figure 1:
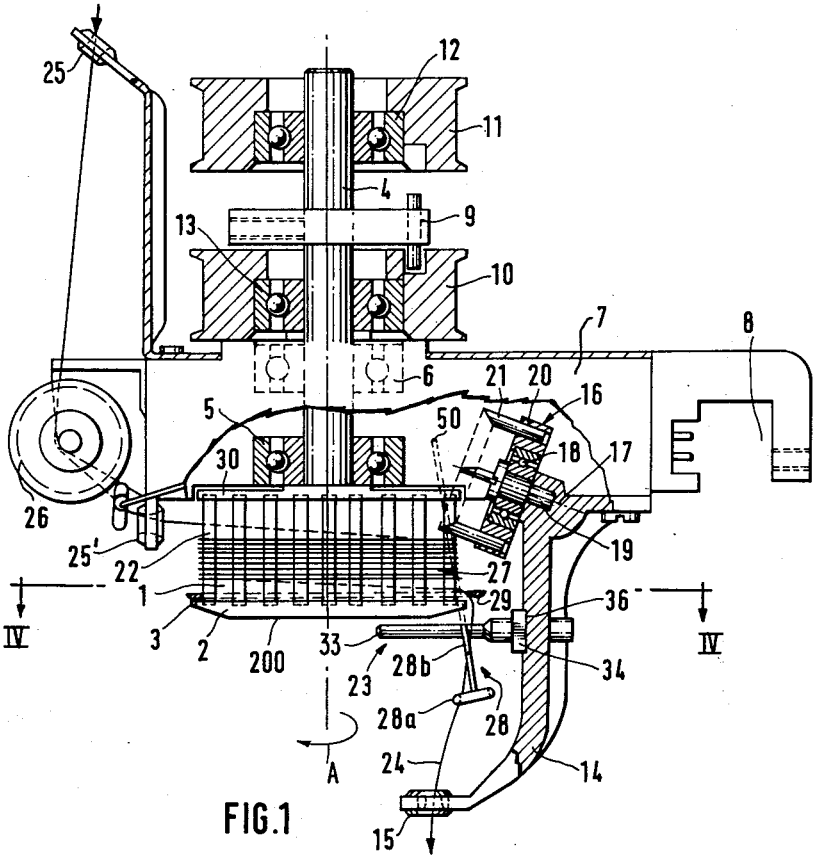
FIG. 1 is a schematic side view of the yarn guide apparatus, partly in longitudinal axial section.

The yarn guide drum 1 (FIG. 1) is a cylindrical cage having two end disks 2, 30. The lower disk 2 is formed with a circumferential yarn pull-off flange 3 which merges into or simultaneously forms the bottom surface 200 of the drum 1. The drum 1 may also be formed as a solid body with corrugated sidewalls, or with slit sidewalls.

The upper support plate 30 of the drum 1 is secured to a shaft 4 which is journalled in bearings 5, 6 which, in turn, are secured to a support frame 7. Shaft 4 rotates about a vertical axis. Frame 7 is formed with an attachment bracket 8 for attachment to a textile machine, for example the thread supply support ring of a circular knitting machine.

A coupling disk 9 is secured to shaft 4. Coupling disk 9 is selectively engageable with either one of pulleys 10, 11, both of which are rotatable with respect to shaft 4, being journalled in respective bearings 13, 12. Pulleys 10, 11 are arranged to be driven by drive belts (not shown) forming the drive for the drum 1 and powered by the textile machine. The speed of rotation of the pulleys 10, 11 may be different, as determined by the different speeds of the respective drive belts. The setting of the coupling disk 9, operating as a clutch, determines the speed, or direction of rotation, respectively, of the drum 1.

An arm 14 is rigidly secured to frame 7. Arm 14 extends parallel to the drum for a short distance, and then beneath the drum. Arm 14 carries a thread guide eye 15 at its lowermost extremity. An axial feed wheel 16 is journalled in arm 14, rotatable about an axis 17.

The feed wheel 16 is a pin-wheel gear or a stub-tooth gear wheel, journalled by ball bearing 18 about a bolt 19 which forms the axis 17 of rotation of the wheel or gear 16. The wheel or gear 16 is a disk 20 which has projecting pins 21 which engage in the gaps or spaces between the rods 22 forming the cage of the drum 1, or between the projections of the undulating surface thereof, or in gaps or grooves formed around the surface of drum 1. The axis of rotation 17 of gear or wheel 16 and the axis of rotation of drum 1 form an acute angle.

Thread guide element 23 is located beneath the feed wheel or gear 16, secured to bracket 14. The thread guide element 23 extends in interfering position in the path of the thread or yarn 24 drawn off the axial end of the drum 1. It forms a pull-off point which is fixed in space with respect to the drum 1.

The yarn or thread 24 is supplied from a cone or other supply source (not shown) through a supply guide eye 25 to a thread brake 26, and then through another supply eye 25' to be tangentially supplied to the circumference of drum 1. The drum 1 will accumulate from 10 to 20 wraps or loops thereon to form a stack of supply windings 27. The lower winding or end is drawn off over the pull-off edge or flange 3, guided over the thread guide element 23 and then through an eye **28*a* of a thread break sensor 28, and then through the run-out eye 15** for supply to the working point of a textile machine, for example a knitting feed of a circular knitting machine (not shown).

Figure 4:
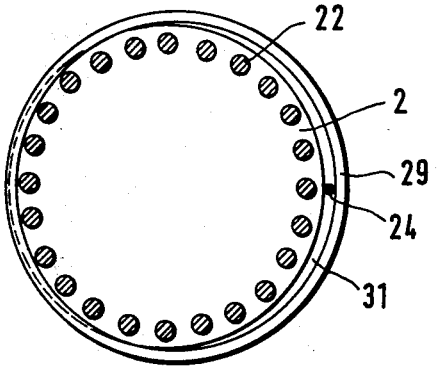
FIG. 4 is an axial top sectional view of the drum of FIG. 1 omitting, however, the illustration of the holding arm and the yarn guide finger, taken along lines IV—IV of FIG. 1.

A ring 29 (FIGS. 1, 4) is loosely slipped over the drum, and held by the end disk 2. The inner diameter of ring 29 is slightly greater than the outer diameter of drum 1, but is less than the inner diameter of the edge 3. Thus, ring 29 is held in position and cannot be removed from the drum. Ring 29 has low weight and acts as a thread brake. It defines, with the circumference of drum 1, a space 31 which decreases, in sickle shape, to permit the yarn 24 to pass therebetween (see FIG. 4).

Figure 3:
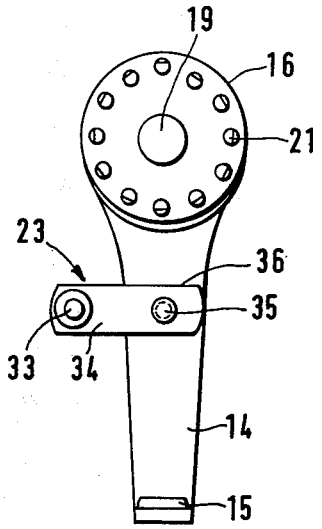
FIG. 3 is a fragmentary, detailed view, taken from the front, of the thread guide element, illustrating the axial yarn feed wheel and the attachment bracket.

The thread guide element 23 is a cylindrical pin or finger 33 which is secured to a transversely extending plate 34 (FIGS. 1, 3). Plate 34 is secured to arm 14 by a screw 35. Plate 34 is guided in arm 14 in a groove 36 formed therein. The pin 33 is held on plate 34 at one end thereof and when secured to arm 14, as shown in FIG. 3, is laterally offset with respect to a diametrical line from screw 35 to the center of rotation of drum 1 or, in other words, is laterally offset in a plane which extends essentially tangentially to the drum 1 at the pull-off point or position of the yarn from the drum 1, as illustrated, for example, by the position of yarn 24 in FIG. 4. The plate 34 is fitted in the groove 36 of arm 14, so that the plate 34 is securely held therein. The plate 34 can be attached to the arm 14 by screw 35 either in the position shown in FIG. 3 or reversed 180° with respect thereto, so that finger 33 will be located at the right side of the screw, rather than as shown.

Figure 2:
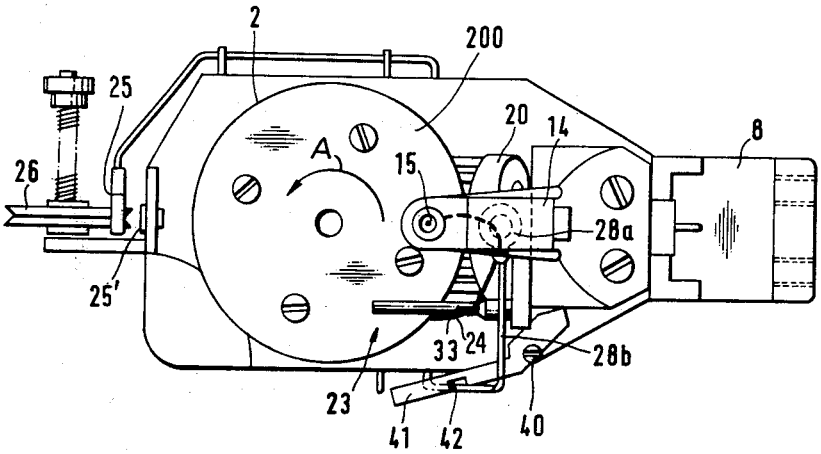
FIG. 2 is a bottom view of the apparatus of FIG. 1.

The axis of rotation of drum 1 coincides with the plane of symmetry of arm 14, as best seen in FIG. 2. Pin 33 is laterally offset with respect to this plane or imaginary line connecting the center of rotation of drum 1 with the center of arm 14. Pin 33 is located below the bottom surface 22 of drum 1, spaced therefrom by only a short distance, which may be less than the diameter of the pin 33 itself. If the direction of rotation of the drum is to be changed, the screw 35 is loosened and plate 34 is flipped to the other direction, 180° reversed with respect to the position shown in FIG. 3, and the screw then tightened when plate 34 is again engaged in groove 36.

The stop-motion sensor 28 has its eye **28*a* located in the path of the thread. The arm 28*b* of the stop-motion device 28 is pivoted to the frame, as shown at 50**, to swing about a horizontal axis.

The stop-motion device might respond if a particular thread guide is being reset or worked on. To prevent spurious response, and hence disconnection of the machine when not needed, a latch is provided to disable response of the thread break sensor 28. As seen in FIG. 2, a latch lever 41 can be pivoted in position to catch the arm **28*b* in a notch 42 formed therein. Latch arm 41 is pivotally mounted by a screw 40 which, upon tightening or loosening, is provided to change the position of latch arm 41**.

Operation: Upon rotation of the drum 1, by driving engagement of at least one of the pulleys 10, 11 with a drive belt and suitable connection of clutch, yarn 24 supplied by guide eye 25' is tangentially wound on the drum 1. The supply windings 27 will accumulate thereon. The feed wheel or gear 16 is driven upon rotation of the drum 1, by engagement of the projecting pins with the gaps between rods, or projections on the drum 1. The teeth 21 of the feed wheel 16 will continuously push the uppermost winding of the stacked windings 27 axially with respect to the drum, in a downward direction.

Yarn 24 is continuously pulled off the lowermost winding of the stacked winding supply 27, with the same speed as the speed of supply to the winding supply 27 at the upper side thereof. The yarn, being drawn or pulled off, runs over the flange 3, in the sickle-shaped space 31 between the ring 29 (which exerts a slight braking drag on the yarn). The yarn 24 is then guided over the pin 33 through eye **28*a* of the thread break sensor 28, and then through eye 15. If the drum rotates in the direction of arrow A (FIGS. 1, 2), that is, from right to left (counter-clockwise in FIG. 2), the pin 33 will be located at the right of the imaginary center line connected with the center of rotation of drum 1. The pin 33 provides lateral guidance for the yarn 24 so that it is not carried along by the edge or flange 3 upon rotation of the drum 1, and engagement with the ring 29. Thus, a pull-off position, fixed in space, will establish itself. The yarn or thread can carry out some longitudinal movement along the length of the pin or finger 33. If the drum operates as seen in FIG. 1**, that is, from left to right, the finger will be located at the left side of the center line.

The yarn or thread running over the pin or finger 33 is then guided through the eye **28*a* of the thread break sensor and then to the final guide eye 15** and then to the knitting feed or other utilization point.

The arm **28*b* of the thread break sensor has slight yarn tension applied thereto. If less thread is used at the utilization point than supplied by drum 1, tension of the yarn 24 will decrease. The lateral offset of the pin 33 with respect to the axis of rotation of drum 1 permits carrying along of some length of yarn or thread by cooperation of the ring 29 with the flange 3, so that yarn which is not accepted by the utilization device can form at least a portion of another winding on the drum 1. Simultaneously, however, the arm 28*b*** of the thread break sensor will begin to rotate about its axis of rotation so that the thread break sensor will be activated by the force applied by its spring bias (supplied by a spring, not shown, and customary in such installations) as well as by the force of the thread which now has a changed path, thus stopping the machine.

Pin 33 is located as close as possible to the bottom surface 200 of the drum 1. The thread 24 is thus automatically and inherently again positioned at its proper pull-off point about the pin 33 if draw-off of the thread was only temporary and had not yet resulted in response of the thread break sensor; alternatively, the yarn will automatically and inherently assume its positive draw-off or pull-off position, for example after a change in direction of rotation of the machine or after stoppage of the machine, or a modification which resulted in more thread accumulation on the drum.

Various changes and modifications may be made within the scope of the inventive concept.

We claim:

1. Thread supply apparatus for positive thread supply, for use with textile machines, comprising a support frame (8, 14);

a rotatable yarn supply storage drum (1) journalled in the support frame for rotation in a clockwise or counter-clockwise direction.

means supplying yarn to said drum (1) to form a stack of supply windings (27) thereon, the yarn being drawn off over the end of the drum from a pull-off position;

a thread break sensor (28) in the path of the yarn and engaged thereby;

a depending arm (14) extending from said frame and adjacent said drum and stationary thread guide means (15) at the end thereof beneath the drum and offset from the axis of the drum;

and a thread guide element (23) including a pin-like finger (33) which is located below the drum (1) in the path of the thread adjacent the pull-off position, and upwardly of the thread guide means (15) and extends in a direction substantially parallel and laterally offset, with respect to a plane containing the axis of rotation of the drum and said guide means (15).

2. Apparatus according to claim 1, comprising an attachment plate (34) located adjacent and below the drum and extending in a direction essentially parallel to a plane tangential to said drum and transverse to said plane through the axis of rotation of the drum, the finger (33) being secured at one end to said plate (34) at a location laterally offset with respect to said tangential plane.

3. Apparatus according to claim 2, wherein the attachment plate is shiftable parallel to said tangential plane to place the laterally offset securing position of the finger (33) at either side of said plane through the axis of the drum.

4. Apparatus according to claim 3, further comprising guide means (36) in said arm (14) locating the attachment plate (34) thereon in selected position at either side of said plane through the axis of the drum.

5. Apparatus according to claim 4, wherein the finger (33) comprises an essentially cylindrical ceramic element having a hard surface and is located spaced from, but closely adjacent to the bottom (200) of the drum (1) and extends essentially parallel to the bottom of the drum.

6. Apparatus according to claim 4, wherein the attachment plate is a strip plate (34) and the guide means (36) is a longitudinal groove or track.

7. Apparatus according to claim 1, wherein the finger (33) comprises a cylindrical pin.

8. Apparatus according to claim 1, wherein the finger (33) comprises an essentially cylindrical ceramic element having a hard surface.

9. Apparatus according to claim 1, wherein the finger (33) is located spaced from, but closely adjacent to the bottom (200) of the drum, and extends essentially parallel thereto.

10. Apparatus according to claim 1, wherein the thread bread sensor (28) is located in the path of the yarn—in the direction of yarn travel—below the finger (33).

11. Apparatus according to claim 8, further comprising means locking the thread break sensor in predetermined locked position.

* * * * *